United States Patent [19]

Palz

[11] Patent Number: 5,033,958

[45] Date of Patent: Jul. 23, 1991

[54] BURNER FOR A HOT-BLAST FURNACE

[75] Inventor: Helmut Palz, Wiesbaden, Fed. Rep. of Germany

[73] Assignee: Didier-Werke AG, Wiesbaden, Fed. Rep. of Germany

[21] Appl. No.: 480,542

[22] Filed: Feb. 15, 1990

[30] Foreign Application Priority Data

May 13, 1989 [DE] Fed. Rep. of Germany ..... 3915704

[51] Int. Cl.[5] ..... F23C 5/08

[52] U.S. Cl. ..... 431/179; 431/170; 431/354; 432/217

[58] Field of Search ..... 431/170, 179, 354; 432/217, 218

[56] References Cited

U.S. PATENT DOCUMENTS

| | | | |
|---|---|---|---|
| 3,044,861 | 7/1962 | Hasche | 432/217 |
| 3,219,096 | 11/1965 | Goeke et al. | 431/179 |
| 4,235,593 | 11/1980 | Malone | 432/217 |
| 4,470,800 | 9/1984 | Wolf | 432/217 |

FOREIGN PATENT DOCUMENTS 1262491 3/1968 Fed. Rep. of Germany .

*Primary Examiner*—Carroll B. Dority

*Attorney, Agent, or Firm*—Wenderoth, Lind & Ponack

[57] ABSTRACT

A burner for a hot-blast furnace has a guidance portion, a channel portion and a mixing portion. The guidance portion serves as an air and gas intake, and is divided into a plurality of separate compartments by thin walled plates. Some of the compartments of the guidance portion have side openings for receiving gas therein, and the other compartments have lower openings for receiving air therein. All of these compartments have exit openings at their top for delivering the air and gas to the channel portion. Conduits are provided in the guidance portion to equalize the pressures within the respective air and gas compartments. The channel portion has a plurality of channels having an overall reduced cross-sectional area of flow as compared with the guidance portion. A mixing portion is disposed above the channels, mixing the air and gas and defining a plurality of burner jets. The reduction in cross-section from the guidance portion increases the velocity of the air and gas going to the burner jets.

14 Claims, 6 Drawing Sheets

BURNER FOR A HOT-BLAST FURNACE

BACKGROUND OF THE INVENTION (1) Field of the Invention

The present invention relates to a burner for a hot-blast furnace, and more particularly relates to a burner having a plurality of parallel, extended compartments alternatingly connected to a gas intake and an air intake, and a mixing area wherein gas and air are mixed and distributed in a plurality of burner jets.

(2) State of the Prior Art

A burner of the above type is described in DE-PS 1 262 491. In the burner of this patent, the flow directions of the two media, gas and air, are each lateral to the extended length of the compartments. This arrangement leads to an unequal flow distribution in the compartments. In order to improve this flow distribution, cross-bars are provided in each compartment. But the cross-bars can only improve the distribution in the respective compartment. They cannot improve the unfavorable flow distribution to the compartments overall. The flow distribution is also unfavorable because the flows of media in the compartments are only first divided into subflows in the burner jets.

A further burner is known in the prior art wherein air in the upper part of the burner is forced through jets. The jets are aimed into a gas flow, the gas flow having a limited momentum. This method of mixing the gas and the air requires a higher mixing energy. During combustion, pulsation can occur. Pulsation is undesirable because pulsation mechanically burdens the burner, causes acoustic disturbances, and unfavorably influences the combustion process. Fluctuations in the heating value of the gas promotes such pulsation.

SUMMARY OF THE INVENTION

Accordingly, the object of the present invention is to provide a burner for a hot-blast furnace of the above type wherein the flow of gas and air is equalized and combustion in the furnace is improved. The present invention accomplishes the above objectives by providing a guidance portion in a hot-blast furnace, the guidance portion having a plurality of parallel compartments. Some of the parallel compartments have an open side portion for taking in one gaseous medium, while the other compartments have an open lower portion for taking in the other gaseous medium. Preferably, gas is admitted by the side portions while air is admitted by the lower portions. Furthermore, the gas entering the guidance portion by the side portions of the compartments enters the guidance portion in a direction of elongation of the guidance portion. All of the compartments of the guidance portion have an exit portion for conducting gas or air therefrom.

A channel portion is preferably provided at the exit portions of the flow compartments of the guidance portion, the channel portion having a plurality of flow channels. One or more flow channels corresponds to a respective flow compartment of the guidance portion. The total cross-sectional area of flow of the channel portion is preferably smaller then the total cross-sectional area of flow of the guidance portion. In particular, each flow channel or set of flow channels in the channel portion has a smaller cross-sectional area than the respective corresponding flow compartment. A mixing portion is connected to the channel portion for receiving and mixing air and gas from the channel portion.

Preferably, the compartments of the guidance portion are separated from each other by thin walled plates. Furthermore, the plurality of flow channels in the channel portion are made of fireproof refractory or ceramic bricks, the fireproof bricks of the plurality of flow channels being thicker than the respective thin walled plates of the compartments to provide for a smaller total cross-sectional area of flow.

The mixing portion defines a plurality of burner jets, each burner jet being connected to at least one flow compartment receiving gas therethrough and at least one flow compartment receiving air therethrough. The mixing portion is connected to the compartments by the channels of the channel portion, the mixing portion being disposed above the channel portion. The channel portion is, in turn, disposed above and connected to the guidance portion at an upper side thereof. Accordingly, the guidance portion has the exit portions of the compartments on an upper side thereof.

Preferably, both the gas intake and air intake comprises high-volume intake compartments. The high-volume intake compartment of the gas intake is located on the side of the guidance portion, and the high-volume intake compartment of the air intake is located below the guidance portion. Advantageously, the guidance portion may also be provided with adjustable openings at the open side portions and open lower portions of the compartments for regulating the gas and air admitted from the gas and air intakes. The gas and air intakes also have a gas line and an air line attached thereto, respectively. Preferably, the total cross-sectional area of flow of the compartments connected to the gas intake is greater than the cross-sectional area of the gas line, and similarly, the total cross-sectional area of flow of the compartments connected to the air intake is preferably greater than the cross-sectional area of the air line.

To equalize the flows through the respective compartments of the guidance portion, a preferred feature of the invention resides in the provision of conduits connecting together respective compartments connected to the gas intake, and conduits connecting together respective compartments connected to the air intake. These conduits extend through the guidance portion perpendicularly to the thin walled plates of the compartments and to the general direction of flow of air and gas. Furthermore, the guidance portion preferably has baffles therein for directing the flows in at least some of the compartments toward the exit portions. These baffles may be provided so as to be adjustable.

A further preferred feature lies in the provision of a grate made of fireproof bricks being disposed above the mixing portion for stabilizing flames of the burner jets of the mixing portion. Also note that a flow adjustment portion may be disposed between the guidance portion and the channel portion for conducting and equalizing air and gas flow from the guidance portion to the channel portion. The adjustment portion comprises a plurality of compartments corresponding to the respective compartments of the guidance portion, as well as a plurality of conduits connecting the respective gas and air compartments together to equalize the pressure in these compartments.

By using only thin walled plates to separate the compartments in the guidance portion, a large amount of space is made available in the guidance portion overall.

The compartments are consequently of a relatively large volume, so that the gas and air entering therein have a relatively low velocity. This arrangement of the compartments with respect to the gas and air flows ensures that the gas and air will be distributed equally to their respective compartments when entering the guidance portion.

A further advantage of the present invention lies in that each compartment opens into one or more channels of the channel portion, which channels are made of fireproof bricks having thick walls in comparison to the thin walled plates of the compartments. The velocity of the flows of air and gas thereby increases as it enters the channel portion. Furthermore, the fireproof bricks give the channels a high mechanical stability and protect the lower thin walls of the guidance portion, typically made of steel, from the absorption of radiant heat from above.

Because the air and gas flows are relatively equally distributed in the channels of the channel portion, as these flows enter and are mixed in the mixing portion the mixing of the two gases is in equal quantities and the flames in all of the burner jets develop equally. This is a prerequisite for complete, quiet and pulsation-free combustion. Also, by the above-noted constriction of the cross-sectional area of the flow, there is a considerable increase in the velocity of the flows in the burner jets. This increase in velocity further favors the mixing process of the gases by increasing the mixing energy.

BRIEF DESCRIPTION OF THE DRAWINGS

Further characteristics, features and advantages of the burner of the present invention will become clear from the following detailed description of a preferred embodiment thereof, with reference to the accompanying drawings, wherein.

DESCRIPTION OF THE PREFERRED EMBODIMENT

Figure 1:
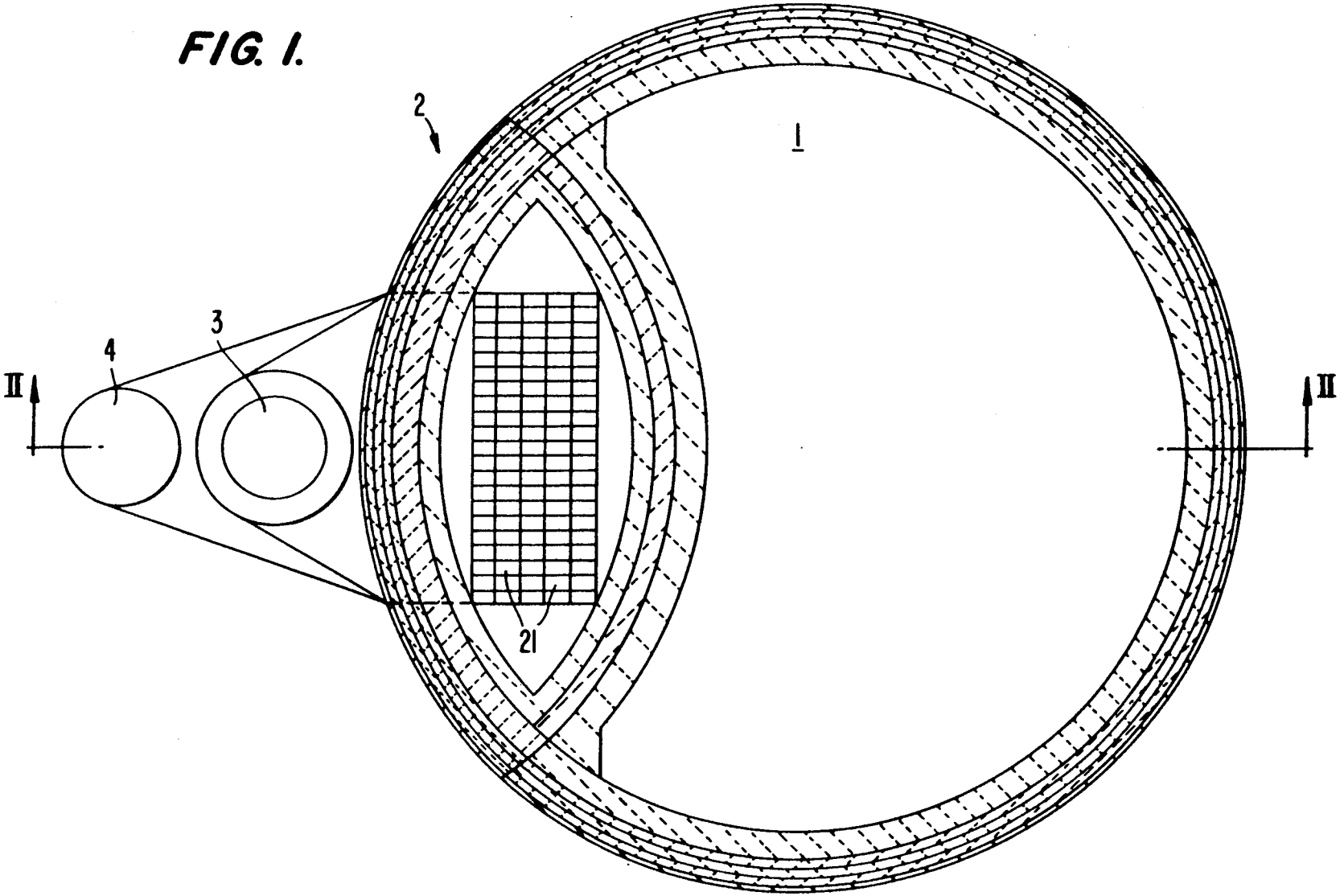
FIG. 1 is a schematic cross-sectional top view of a hot-blast furnace having a burner according to the present invention.
Figure 2:
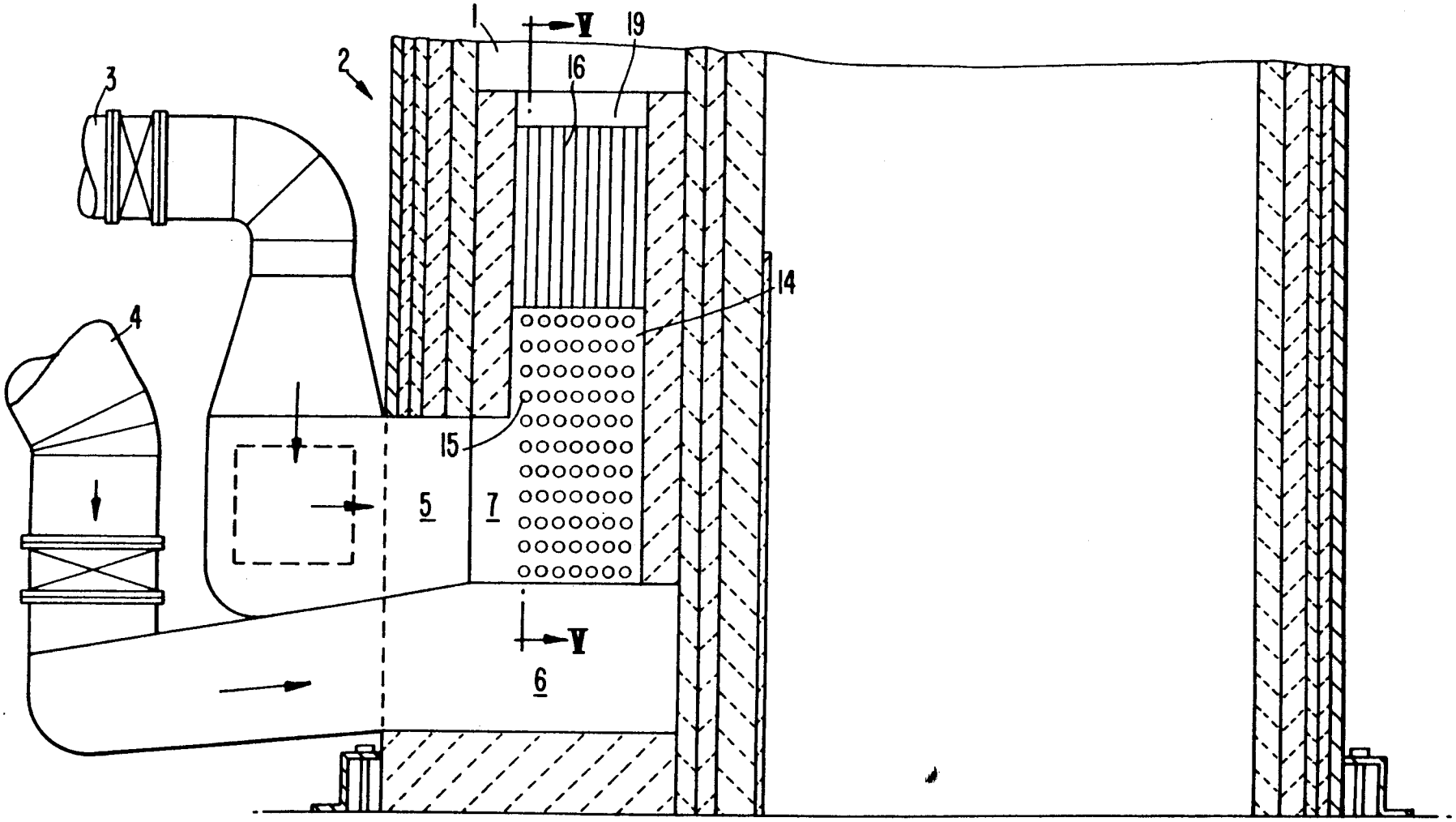
FIG. 2 is an elevational cross-sectional view of the burner taken along line II—II of FIG. 1.

Initially referring to FIGS. 1 and 2, a hot-blast furnace 1 has a burner 2 built therein. A gas line 3 and an air line 4 are attached, one above the other, to the burner. The gas line 3 connects to an intake compartment 5 of the burner 2, and the air line 4 connects to an intake compartment 6 of the burner 2. Preferably, the cross-sectional areas of the flows through the intake compartments 5 and 6 are significantly larger than the cross-sectional area of the gas line 3 and air line 4, respectively. The intake compartments are disposed adjacent a guidance portion 7 of the burner 2.

The guidance portion 7 is used to guide air and gas from their respective intakes up toward the combustion portion of the burner. In accordance with a first preferred feature of the present invention, one of the air and gas is received on a side of the guidance portion 7, and the other of the air and gas are received below the guidance portion 7. Preferably the gas intake compartment 5 is disposed laterally of the guidance portion 7 and the air intake compartment 6 is below the guidance portion 7. Furthermore, the guidance portion 7 preferably is made up of a number of thin walled plates 8 of, for example, steel suitable for high temperature operations, cast iron or refined ceramics. The thin walled plates 8 divide the guidance portion 7 into a number of separate compartments 9. The thin walled plates 8, and thus the compartments 9, extend from left to right and top to bottom in the guidance portion 7 as shown in FIG. 2.

Figure 5:
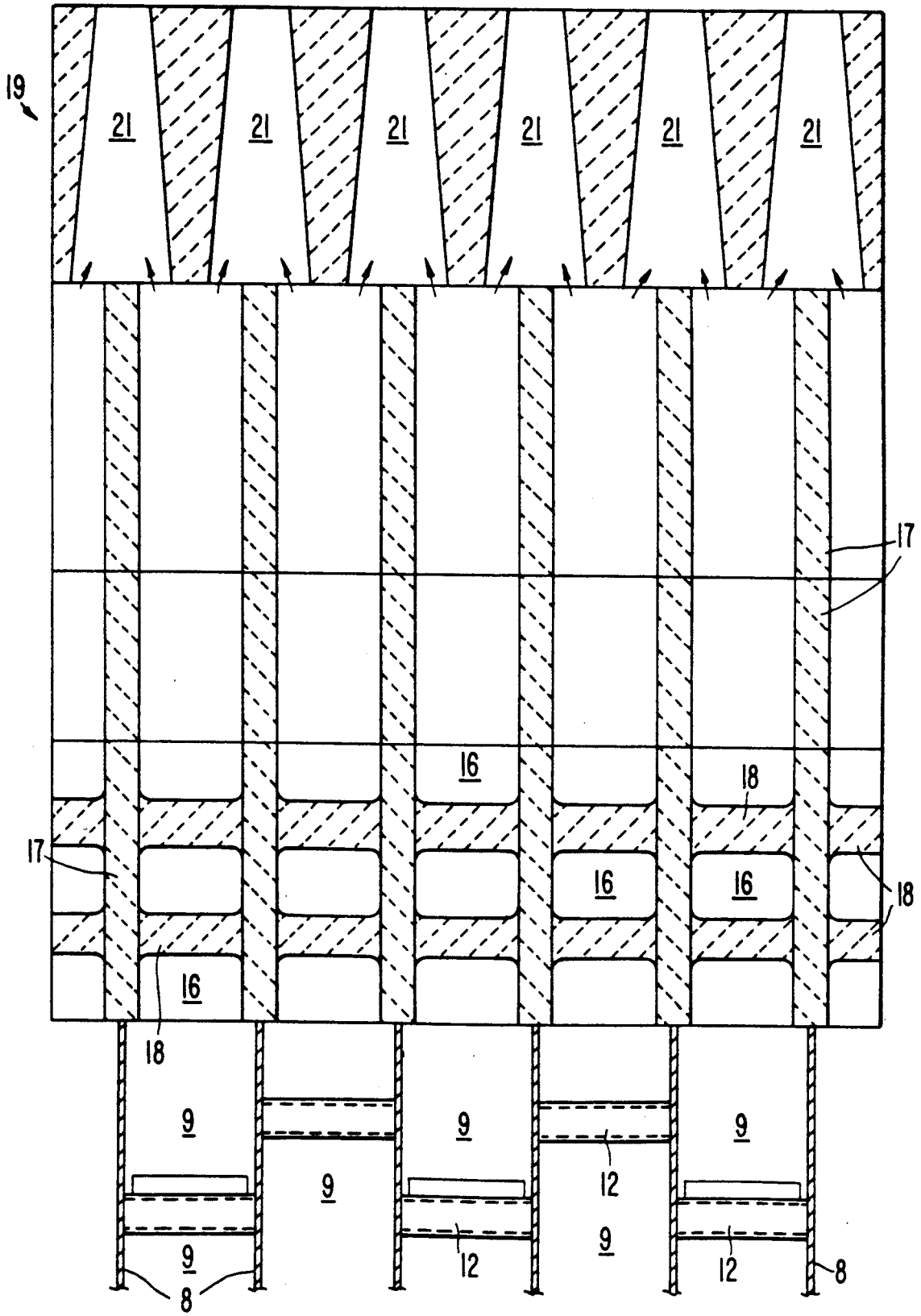
FIG. 5 is a view of the upper portion of a mixing portion, a channel portion and the guidance portion taken along line V—V of FIG. 2.

Some of the compartments have an open side facing the gas intake compartment 5 and are closed off by a wall of the guidance portion 7 from the air intake 6, while the other compartments have open lower portions facing air intake 6 while being closed off by a wall of the guidance portion 7 from gas intake 5. Thus the air and gas are conducted into and through the guidance portion 7 in separate compartments 9. In a preferred form of the present invention, the compartments 9 alternate along the guidance portion 7 between receiving air and gas therethrough, as shown in FIG. 5. Note that all of the compartments 9 are open at their tops to form exit portions.

Figure 3:
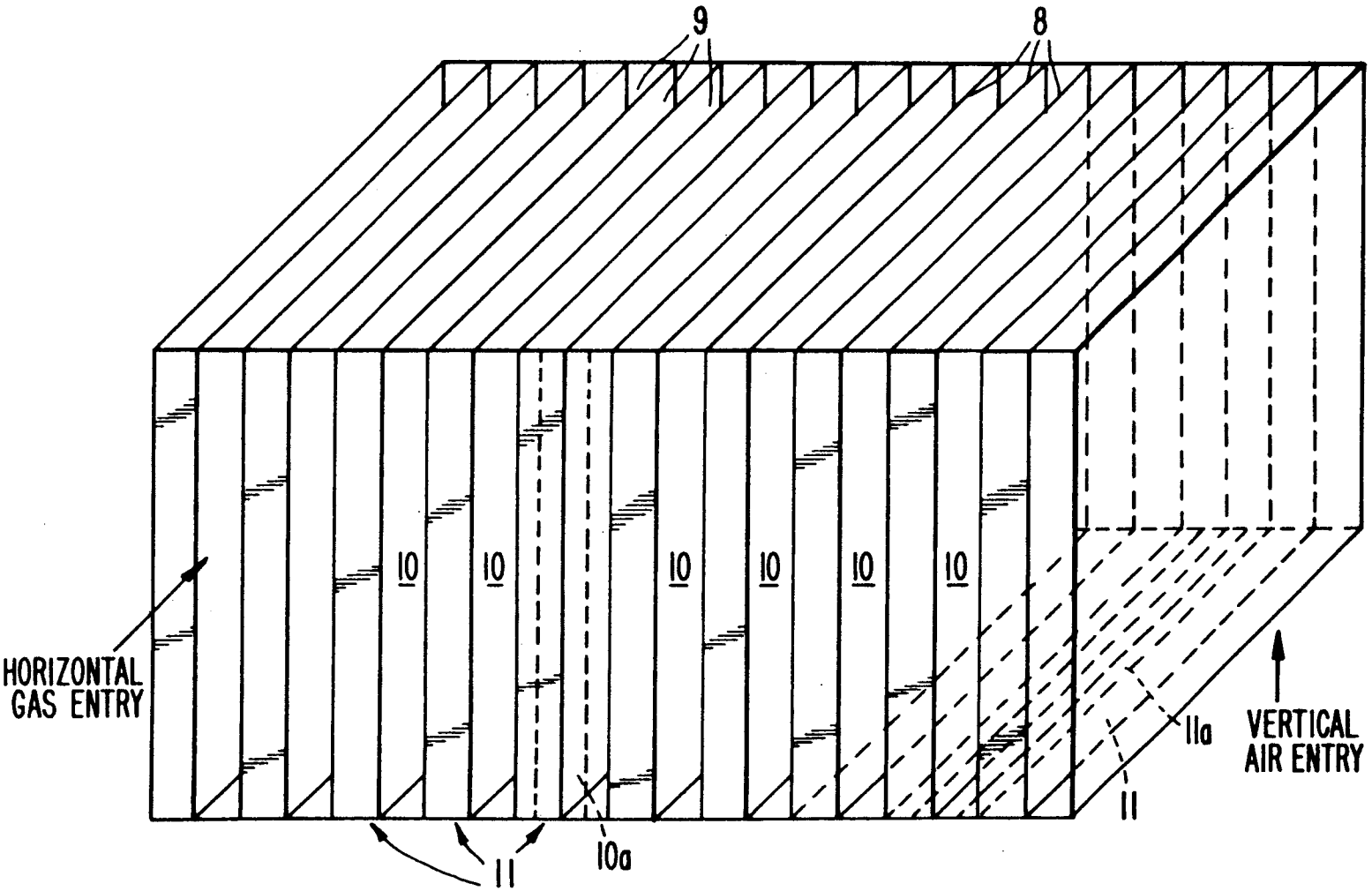
FIG. 3 is a schematic perspective view of a guidance portion of the burner according to the present invention.
Figure 6:
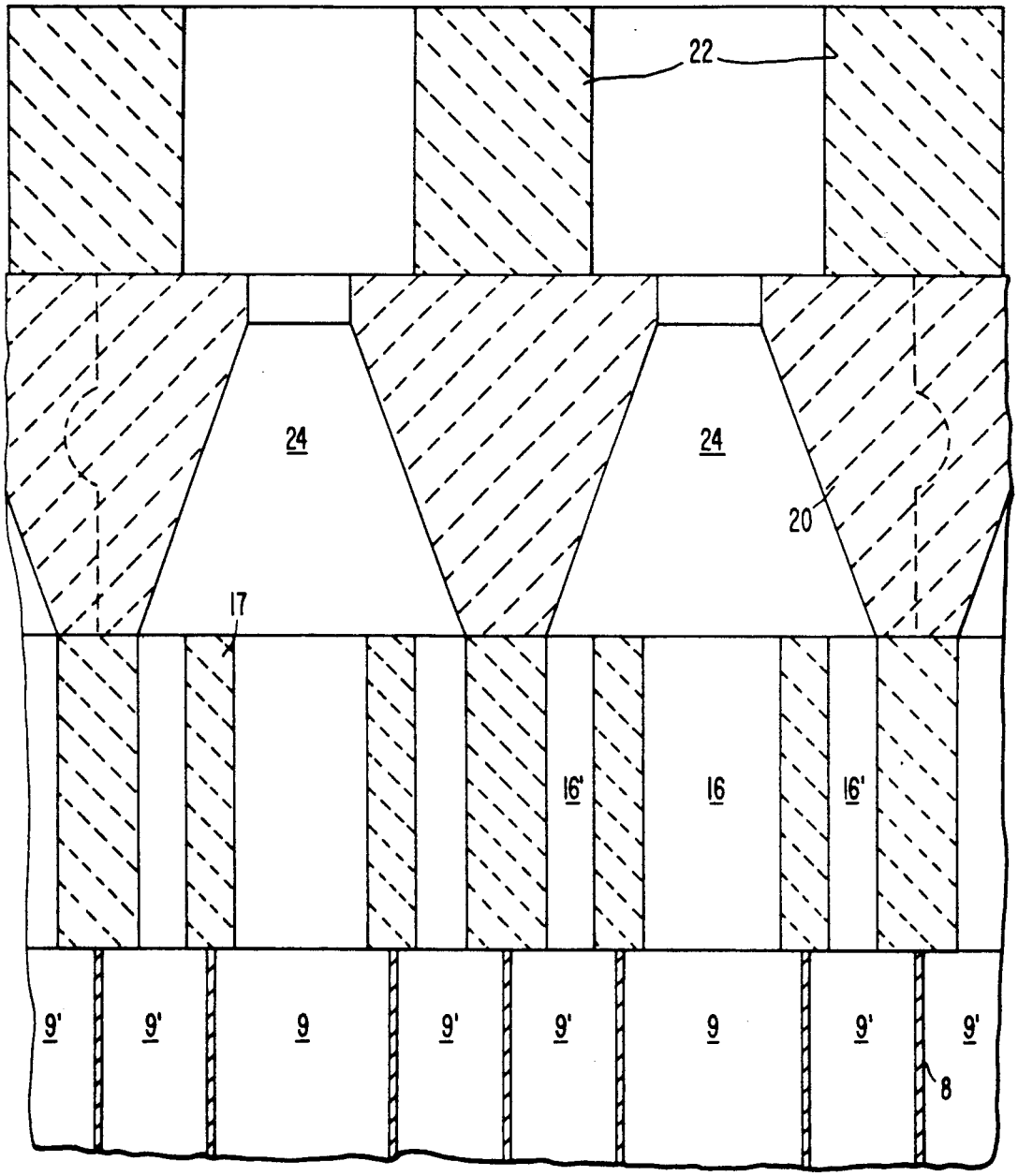
FIG. 6 is a view similar to FIG. 5 but showing an alternative embodiment of the mixing portion, channel portion and guidance portion.

According to an example of the guidance portion 7 shown in FIG. 3, the distances between each of the thin walled plates 8 are all the same. However, the distances may also vary in order to vary the size of the compartments, for example to render the size of a compartment for gas larger than a compartment for air. For example, noting FIG. 6, compartments 9 receiving gas therein are approximately twice as wide as compartments 9' receiving air therein. Also note that in FIG. 6 there are two compartments 9' for air for each compartment 9 for gas.

Noting again FIG. 3, the respective open portions of the various compartments may be provided with adjustable apertures in order to regulate the flow of gas or air entering a particular compartment. Thus, as can be seen in FIG. 3, an open side portion 10 for gas may be provided with an adjustment member 10*a*, and an open lower portion 11 may be provided with an adjustment member 11*a*. By providing the compartments 9 with adjustment members, individual compartments can be closed off, or their cross-sectional area can be adjusted. With such a feature the burner 2 can also be operated with a smaller amount of combustion, as is desirable when warming the hot-blast furnace.

Figure 4:
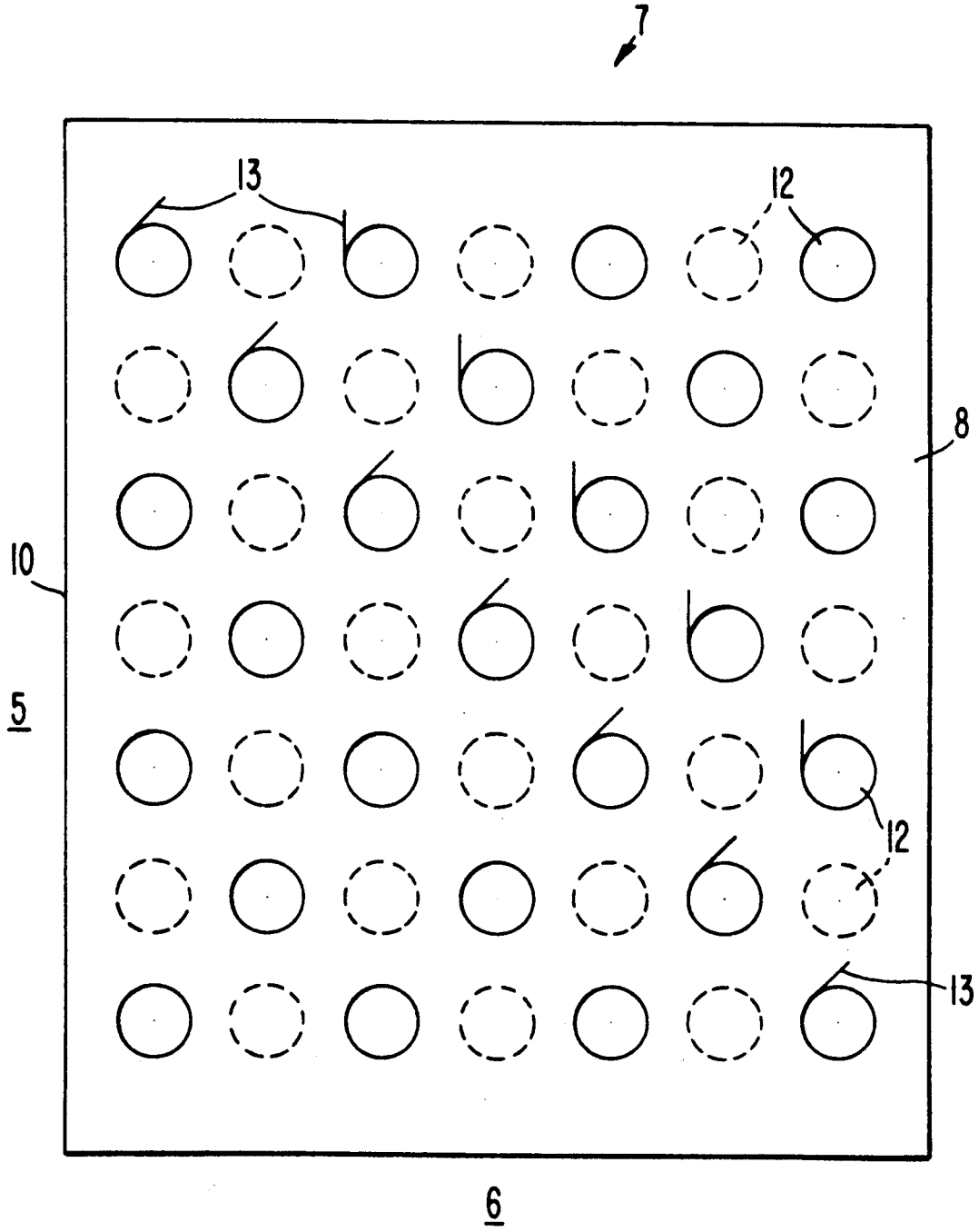
FIG. 4 is a view of the guidance portion of FIG. 3 from one side thereof and including a plurality of pressure equalizing conduits.

In a further preferred feature of the invention, an arrangement is provided whereby the pressure in respective gas compartments and respective air compartments is equalized. Specifically, noting FIG. 4, conduits 12 are provided between the thin walls 8 of the compartments 9 in order to connect one gas compartment with another and one air compartment with another. The conduits 12 preferably extend perpendicularly to the plates 8 in the guidance portion 7. Furthermore, some of the conduits 12 may extend through several compartments 9. The conduits 12 are open at both ends thereof to allow one air compartment to communicate with another, and one gas compartment to communicate with another. An equalized flow across the guidance portion 7 is thereby obtained with respect to both the gas flow and the air flow. A plurality of baffles 13 are provided on the conduits 12 in the various compartments of the guidance portion 7. The baffles 13 help to redirect the gas flow from its intake direction on the side of the guidance portion 7 to its exit point on the upper portion of the guidance portion 7. Preferably, the baffles 13 are adjustable (note that conduits 12 and baffles 13 are not shown in FIG. 3).

An additional guidance, or flow adjustment, portion 14 may be attached to the top of the guidance portion 7 in the burner as illustrated in FIG. 2. This adjustment portion 14 is constructed essentially the same as the guidance portion 7. Thus the adjustment portion 14 has both air conducting and gas conducting compartments extending from below to above. The compartments of the adjustment portion 14 are aligned with the compartments 9 of the guidance portion 7. Conduits 15, similar to the conduits 12, may be provided in the adjustment portion 14 to provide for further flow equalization between the respective gas conducting compartments and the respective air conducting compartments. However, it should be noted that an adjustment portion 14 is not required in every situation. Accordingly, this feature should be considered optional.

A channel portion is provided above the adjustment portion 14, as shown in FIG. 2. The channel portion is made up of a plurality of channels 16, which can be more clearly seen in the examples shown in FIG. 5 and FIG. 6. The channels 16 are made of molded fireproof ceramic bricks 17. Each compartment 9 empties into several such channels 16. In accordance with a further preferred feature of the present invention, the total cross-sectional area of flow of the channels 16 corresponding to a compartment 9 is smaller than the cross-sectional area of the flow of the respective compartments 9. Because of this feature, the flow velocity of the air and gas in the channels 16 increases with respect to the velocity in the compartments 9. Note that the molded bricks 17 may be provided with projections 18 forming flow bodies in the channels 16, causing a redirection of flow in the channels 16, and thereby further equalizing the flow of the air or gas through the respective channel 16.

Above the channel portion is provided a mixing portion 19. The mixing portion 19 is made out of molded fireproof ceramic bricks 20. The molded bricks 20 form tapered burner jets 21. Each burner jet 21 has a rectangular cross-section (see FIG. 1). The respective burner jets 21 are disposed with respect to each channel 16 such that each burner jet 21 receives both air and gas therein. Because of the tapered form of each burner jet 21, the flow velocity of the gas and air mixture increases in the burner jet. The increase in velocity further favors a good mix of the gas and the air because of the increase in the mixing energy. As seen in the example shown in FIG. 5, a portion of the air from one air channel 16 and a portion of the gas from one gas channel 16 empties into each burner jet 21. But note the alternative arrangement shown in FIG. 6, wherein the air channels 16', corresponding to the different width of the compartment 9', are not as wide as the gas channel 16. Indeed, one gas conducting channel 16 and two air channels 16' empty into each burner jet 21.

Still noting FIG. 6, an optional feature of the present invention resides in the provision of a grate 22 disposed on the molded bricks 20 of the mixing portion 19. The grate 22 is also made of molded fireproof ceramic bricks. As seen in the figure, the bricks of the grate 22 are recessed back from the edges of the bricks 20 of the mixing portion 19, and are thus recessed from the flame side of the burner jets 21. This arrangement tends to stabilize the flames of the burner jets 21.

As noted above, an important features of the present invention are the respective changes in cross-sectional area of flow from portion to portion. As an example, the cross-sectional areas of the flow in the individual portions can be determined in approximately the following manner. The total cross-sectional area of flow on the flame side or exit side of the burner jets 21 is approximately equal to the sum of the cross-sectional areas of the intake lines 3 and 4. Intake lines 3 and 4 have approximately the same cross-sectional area. The cross-sectional area of flow of the respective intake compartments 5 and 6 is approximately four to five times the cross-sectional area of each respective intake line 3 or 4. However, the cross-sectional area of flow is constricted to approximately one half in the compartments 9 of the guidance portion 7. The cross-sectional area of flow is again constricted by about one half in the channels 16. With the changes in cross-sectional area there is a corresponding decrease of flow velocity in the intake compartments 5 and 6. With the decrease in cross-sectional area, there is a corresponding increase in flow velocity into the burner jets 21.

Although the present invention has been described and illustrated with respect features thereof, it is to be understood that various modifications and changes may be made to the specifically described and illustrated features without departing from the scope of the present invention.

We claim:

1. A burner for a hot-blast furnace, comprising:

a guidance portion comprising a plurality of separate flow compartments, some of said compartments having an open side portion for connection to one of a gas intake and an air intake, the other said compartments having an open lower portion for connection to the other of the gas intake and the air intake, and all of said compartments having an exit portion;

a channel portion having a plurality of flow channels therein connected to respective said exit portions of said flow compartments of said guidance portion for receiving gas and air therefrom, wherein the total cross-sectional area of flow of said channel portion is smaller than the total cross-sectional area of flow of said guidance portion; and a mixing portion connected to said channel portion for receiving and mixing air and gas from said channel portion.

2. The burner as set forth in claim 1, wherein:

said compartments of said guidance portion are formed by thin walled plates.

3. The burner as set forth in claim 1, wherein:

said plurality of flow channels are defined by fireproof bricks.

4. The burner as set forth in claim 1, wherein:

said mixing portion comprises a plurality of burner jets, each said burner jet being connected to at least one said flow compartment having an open side portion by a said flow channel and at least one flow compartment having an open lower portion by a said flow channel.

5. The burner as set forth in claim 1, wherein:

said exit portions of said compartments are on an upper side of said guidance portion.

6. The burner as set forth in claim 1, wherein:

said guidance portion further comprises conduits therein connecting compartments having open side portions together and conduits connecting compartments having open lower portions together in order to equalize the pressure in respective said gas and air flow compartments of said guidance portion.

7. The burner as set forth in claim 6, wherein:

said conduits extend through compartments of said guidance portion perpendicular to the general direction of flow of air and gas.

8. The burner as set forth in claim 1, wherein:

said guidance portion further comprises baffles for directing the flow from said one of said gas intake and said air intake toward said exit portions.

9. The burner as set forth in claim 1, wherein:

said compartments of said guidance portion are formed by thin walled plates;

said plurality of flow channels are defined by fireproof bricks; and said fireproof bricks are thicker than said thin walled plates.

10. The burner as set forth in claim 1, wherein:

said mixing portion comprises a plurality of burner jets; and a grate made of fireproof bricks is disposed on said mixing portion for stabilizing flames of said burner jets.

11. The burner as set forth in claim 1, and further comprising:

an adjustment portion disposed between said guidance portion and said channel portion, said adjustment portion comprising a plurality of adjustment compartments corresponding to said compartments of said guidance portion and a plurality of conduits connecting said adjustment compartments for receiving gas therein together and connecting said adjustment compartments for receiving air therein together in order to equalize the pressure in the respective said gas and air adjustment compartments.

12. The burner as set forth in claim 1, and further comprising:

a gas intake connected to said open side portions of said compartments of said guidance portion; and an air intake connected to said open lower portion of the other said compartments of said guidance portion.

13. The burner as set forth in claim 12, wherein:

said gas intake comprises a high-volume intake compartment on one side of said guidance portion and said air intake comprises a high-volume intake compartment beneath said guidance portion.

14. The burner as set forth in claim 12, and further comprising:

a gas line attached to said gas intake; and an air line attached to said air intake;

wherein the total cross-sectional area of flow of said flow compartments connected to said gas intake is greater than the cross-sectional area of said gas line, and the total cross-sectional area of flow of said flow compartments connected to said air intake is greater than the cross-sectional area of said air line.

* * * * *